United States Patent [19]

Häger

[11] 4,305,978

[45] Dec. 15, 1981

[54] PROCESS FOR TREATMENT OF WOOD

[76] Inventor: Bror O. Häger, Kryssarvägen 17, S-183 52 Täby, Sweden

[21] Appl. No.: 125,774

[22] Filed: Feb. 29, 1980

[30] Foreign Application Priority Data

Mar. 5, 1979 [SE] Sweden ..... 7901957

[51] Int. Cl.[3] ..... B05D 1/18; B05D 3/12

[52] U.S. Cl. ..... 427/351; 427/298; 427/393; 427/441

[58] Field of Search ..... 427/351, 298, 393, 440, 427/441

[56] References Cited

U.S. PATENT DOCUMENTS

| | | | |
|---|---|---|---|
| 831,450 | 9/1906 | Lowry | 427/351 |
| 1,499,791 | 7/1924 | Shipley | 427/351 |
| 2,652,347 | 9/1953 | Hudson | 427/351X |
| 3,560,251 | 2/1971 | Hager | 427/351 |
| 3,995,077 | 11/1976 | Hager | 427/298 |

*Primary Examiner*—Michael R. Lusignan

*Attorney, Agent, or Firm*—Burns, Doane, Swecker & Mathis

[57] ABSTRACT

An improved wood preservation process is disclosed wherein wood is contacted with an emulsion of an oil-based perservative in water.

12 Claims, No Drawings

PROCESS FOR TREATMENT OF WOOD

BACKGROUND OF THE INVENTION

Processes have been developed for the preservation, drying and coloring of wood. Such processes are described in Swedish Pat. No. 301,870, U.S. Pat. No. 3,560,251, and Canadian Pat. No. 842,194. Such processes include an initial pressure treatment of the wood with an aqueous preservative-containing solution. The treated wood is thereafter dried in warm oil under a vacuum. The oil provides the wood with a water repellent surface. The wood can also be colored by pigmenting the oil.

Similar processes have also been developed where the treatment with the preservative is carried out with the preservatives being dissolved in organic solvents. The solvent is thereafter evaporated from the wood in warm oil under a vacuum. It was initially believed that the solvent and the wood-drying oil had to be insoluble in each other to achieve full evaporation. Experiments have shown, however, that this point of view has not been correct under certain conditions as described in Swedish Pat. No. 401,994, U.S. Pat. No. 3,995,077, and Canadian Pat. No. 1,051,292.

However, such prior art processes have certain disadvantages.

For example, in the first described prior art process an ammoniacal solution containing copper compounds has been used as a preserving agent. The copper compounds provide effective protection. The solution does not attack iron and the treatment apparatus remains relatively clean. The water-soluble copper compounds, however, impart a green color to the wood. This is a definite disadvantage as it makes it impossible to apply lighter colors while also limiting the possibility of employing other desired colors. The copper compounds further exhibit a destructive effect upon the oils, and especially upon the drying oils (e.g., linseed oil). Drying oils are desirably present in the wood-drying oil mixture to obtain a more permanent coloring of the wood. Even ammonia causes a certain coloring of the wood while also influencing the linseed and the other drying oils. After being used for some time the oil mixture is no longer fit for use and must be replaced. Typically such oil mixtures are replaced after 150 operations or so.

In the second described prior art process wherein an organic solvent solution is used in the preservation treatment, the coloring result obtained is not of the same high quality as when the treatment is carried out with water soluble preservatives. For this reason the first process has generally been preferred commercially.

However, in the process of the present invention, preservatives free of oil-attacking copper and ammonia can be used since the treatment solution is in the form of an emulsion. The preservatives of the present invention are less prone to attack the oils. The use of an emulsion with a high content of water also provide satisfactory coloring of the wood. Another advantage is that no evaporating solvents are needed to dissolve the preservative. In addition, the emulsifier is relatively inexpensive.

DETAILED DESCRIPTION OF THE INVENTION

An oily preservative or a preservative which is soluble in oil (i.e., oil-based preservatives) are used in the process of the present invention. This agent as such is emulsified in water. The preservative treatment is carried out with the emulsion. After the treatment with the emulsified preservative solution, the emulsion is removed from contact with the wood. A high boiling oil is then introduced and the wood is dried at an elevated temperature under a vacuum. With the exception that the preservative treatment is carried out with an emulsion the process is similar to the earlier described processes. Conditions of pressure and temperature as well as the wood-drying coloring oil are conventional. The wood-drying coloring oil is also pigmented in a conventional manner.

Zinc (or copper) naphthenate, copper tallate, pentachlorophenol, and organic tin compounds, etc. can be used as preservatives. Other suitable compounds include acridine, anthracene, different naphtols, naphthylamin, quinoline and pyridine. The use of such preservatives is conventional and this list is non-inclusive.

Mixtures of different emulsifiers can be used. Suitable emulsifiers are sold under the tradenames Berol 02, Berol 048, Berol 102, Berol 302, and EMU 79. This list is not intended to be all-inclusive and other emulsifiers may be used. Emulsifiers may be used separately or in admixture with one another.

Zinc naphthenate and copper tallate are oily preservatives and can be emulsified without adding an oil. The others preferably are dissolved in oil (preferably a high boiling oil) before they are emulsified in water. The use of such high boiling oils is advantageous as they enhance the water repellent properties of the wood.

The concentration of the oil-based preservative in the emulsion can be varied within wide ranges depending on the amount of the emulsion (and accordingly the amount of preservative) which has to be introduced into the wood and the method used for the introduction. The concentration is generally lowest when a full cell treatment is employed than when the Lowry or Ruping methods are used since the latter methods introduce lesser amounts of preservative into the wood. The concentration of the oil-based preservative in the emulsion will thus vary inversely with the amount of emulsion introduced into the wood by each method. That is, if the Lowry method introduces 150 $kg/m^3$ of emulsion into the wood and the Ruping method introduces 75 $kg/m^3$, the concentration of preservative in the method used in the Ruping method must be twice that used in the Lowry method. The concentration will also, of course, be lower if a lower concentration of preservative in the wood is desired. As a rule the concentration of the oil-based preservative in the emulsion will range between about 5 and about 20 percent by weight.

As a rule the Lowry treatment is adapted for use with an emulsion containing about 10 percent by weight of oil-based preservative. Thus, for example, in the treatment of Swedish pine 150 kilgrams of emulsion are preferably introduced per cubic meter of wood. Thus, 15 kilograms of the emulsified product will remain in the wood upon drying. The emulsion must not deliver a product to the wood of too low a viscosity since difficulties can arise in the coloring step. The use of drying oils in the emulsion can, however, enable a higher viscosity to be achieved.

It is comparatively easy to provide emulsions which are suitable for use in the present invention and to introduce them into the wood. It may also be said that the wood which is intended to be treated according to the present process preferably has minimal dimensions. It is therefore comparatively easy to pressure treat the wood. The emulsified preservative particles protect the wood against wood destroyers, air and moisture.

Exemplary emulsions for use in the present invention may be prepared as follows:

1. To 17 kilograms of zinc naphthenate is added 1 kilogram of an emulsifier (EMU 79 or Berol 02) and 180 kilograms of water. After a short period of stirring an emulsion is obtained which contains one percent Zn.

2. To 16 kilograms of tall oil acid are added 3 kilograms of copper acetate. The mixture is heated to 200° C., during which heating acetic acid leaves the mixture. To the mixtuee is added 0.5 kilogram of Berol 02 and 180 kilograms of water containing 0.5 kilogram Berol 048. After a short period of stirring an emulsion is obtained containing a half percent Cu.

3. To 20 kilograms of crude linseed oil is added 2 kilograms of pentachlorophenol. The mixture is heated to 100° C. whereby the chlorophenol is dissolved. Thereafter 0.5 kilogram of Berol 302, 0.5 kilogram of Berol 102, and 180 kilograms of water containing a small amount acetic acid are added. After a short period of stirring an emulsion is obtained containing one percent pentachlorophenol.

The preservation treatment can advantageously be carried out according to the Ruping method if plants equipped for this purpose are available. As these plants are expensive it may, however, be more suitable to use the Lowry method.

The invention is additionally illustrated in connection with the following Example which is to be considered as illustrative of the present invention. It should be understood, however, that the invention is not limited to the specific details of the Example.

EXAMPLE

Wood is placed in an iron cylinder and impregnated with a suitable emulsion (e.g., one of those previously exemplified) under a pressure of 8 kilograms per square centimeter for a period of 90 minutes. In this way, the wood is penetrated by the emulsion. Thereafter the emulsion is withdrawn from the cylinder and an 80 percent vacuum is applied for 30 minutes. During this vacuum treatment a part of the emulsion which was injected into the wood is driven out again. As a rule 150 kilograms of emulsion per cubic meter of wood remain. The emulsion which is driven from the wood during the vacuum treatment is removed from the cylinder. Without breaking the vacuum pigmented wood-drying oil is pumped into the cylinder. The oil (pigmented or not) may consist of equal parts of mineral oil and linseed oil. The oil mixture and the wood are kept under vacuum and at a temperature between 60° and 90°, usually 80° C. to dry the wood. During this period (usually 3 to 6 hours) the wood is dried, i.e., the water in the emulsion in the wood boils away.

After the wood has been dried in this manner the oil is withdrawn from the cylinder under vacuum. If the vacuum is broken at this time, much oil will be forced into the wood by the outer atmospheric pressure. As a rule this is not desirable. The wood is now preserved, dried and colored. The preservation treatment with the emulsion and the treatment with hot oil also give the wood good resistance to air, sun, and moisture.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

I claim:

1. A process for the preservation of wood and other organic products comprising impregnating said product with an emulsion of an oil-based preservative in water, drying the impregnated product under a vacuum in oil at a temperature of between about 60° and 90° C., withdrawing the oil from the product without breaking the vacuum, and recovering the treated product.

2. A process according to claim 1 wherein the oil-based preservative comprises an oily preservative.

3. A process according to claim 1 wherein the oil-based preservative comprises a preservative which is dissolved in an oil.

4. The process of claim 3 wherein said oil in which said preservative is dissolved has a high boiling point.

5. The process of claim 1 wherein said product is dried under a vacuum at a temperature of about 80° C.

6. The process of claim 1 wherein said oil is pigmented so as to impart color to the product.

7. The process of claim 1 wherein said emulsion comprises from about 5 to about 20 percent by weight of said oil-based preservative.

8. The process of claim 1 wherein said process is carried out according to the Lowry method.

9. The process of claim 1 wherein said process is carried out according to the Ruping method.

10. The process of claim 2 wherein said oily preservative comprises zinc naphthenate.

11. The process of claim 2 wherein said oily preservative comprises copper tallate.

12. The process of claim 3 wherein said preservative comprises pentachlorophenol.

* * * * *